US008037587B1

(12) United States Patent
Lott

(10) Patent No.: US 8,037,587 B1
(45) Date of Patent: Oct. 18, 2011

(54) WATERCRAFT ANODE REMOVAL TOOL AND METHOD

(76) Inventor: Glenn R. Lott, Hesperia, CA (US)

( * ) Notice: Subject to any disclaimer, the term of this patent is extended or adjusted under 35 U.S.C. 154(b) by 1037 days.

(21) Appl. No.: 11/870,784

(22) Filed: Oct. 11, 2007

(51) Int. Cl.
*B25B 27/14* (2006.01)

(52) U.S. Cl. ..... 29/278; 29/255; 29/263; 29/272; 29/280

(58) Field of Classification Search ..... 29/255, 29/263, 272, 280; 81/176.15, 124.2, 124.7, 81/121.1, 119
See application file for complete search history.

(56) References Cited

U.S. PATENT DOCUMENTS

| | | | | | |
|---|---|---|---|---|---|
| 2,270,092 | A * | 1/1942 | Thompson | 81/176.15 |
| 2,719,042 | A * | 9/1955 | Espy | 81/177.2 |
| 3,423,305 | A * | 1/1969 | Tausk | 204/196.15 |
| 3,760,659 | A * | 9/1973 | Campbell | 81/176.15 |
| 3,837,244 | A | 9/1974 | Schera, Jr. | |
| 4,084,454 | A * | 4/1978 | Day | 81/124.7 |
| 4,569,259 | A * | 2/1986 | Rubin et al. | 81/121.1 |
| D402,517 | S | 12/1998 | Gracia et al. | |
| 6,125,519 | A * | 10/2000 | Kaibach et al. | 29/275 |
| 6,257,099 | B1 | 7/2001 | Rosenbaum | |
| 6,374,708 | B1 * | 4/2002 | Kunz | 81/124.2 |
| 6,564,679 | B1 * | 5/2003 | Llamas et al. | 81/176.15 |
| 6,584,662 | B1 * | 7/2003 | Krick | 29/263 |
| 6,711,975 | B1 | 3/2004 | Vollmer | |
| 6,997,660 | B2 * | 2/2006 | Fedor | 411/383 |
| 7,392,576 | B2 * | 7/2008 | Fedor | 29/558 |

* cited by examiner

*Primary Examiner* — George Nguyen

(57) ABSTRACT

A watercraft anode removal tool and method includes providing a zinc pencil that defines an anode inserted into a watercraft engine. A tool is provided for engaging the zinc pencil. The tool includes a cylinder having a first end, a second end and peripheral wall extending between the first and second ends. The first end has a well therein for receiving an end of the zinc pencil. The well is threaded and is threadably couplable to the zinc pencil. The cylinder is threadably coupled to the zinc pencil and the zinc pencil is pulled from the engine.

6 Claims, 3 Drawing Sheets

WATERCRAFT ANODE REMOVAL TOOL AND METHOD

BACKGROUND OF THE INVENTION

Field of the Invention

The present invention relates to anode removal tools and more particularly pertains to a new anode removal tool for assisting in a person in removing an anode, commonly called a zinc pencil, from an engine component.

SUMMARY OF THE INVENTION

The present invention meets the objectives presented above by generally comprising a cylinder that has a first end, a second end and peripheral wall extending between the first and second ends. The first end has a well therein for receiving an end of a zinc pencil attached to an engine component. The well is threaded and is threadably couplable to the zinc pencil. The cylinder is threadably coupled to the zinc pencil and the cylinder pulled to remove the zinc pencil from the engine.

The present invention also meets the objectives presented above by generally providing a zinc pencil that defines an anode inserted into a watercraft engine. A tool is provided for engaging the zinc pencil. The tool includes a cylinder having a first end, a second end and peripheral wall extending between the first and second ends. The first end has a well therein for receiving an end of the zinc pencil. The well is threaded and is threadably couplable to the zinc pencil. The cylinder is threadably coupled to the zinc pencil and the zinc pencil is pulled from the engine.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
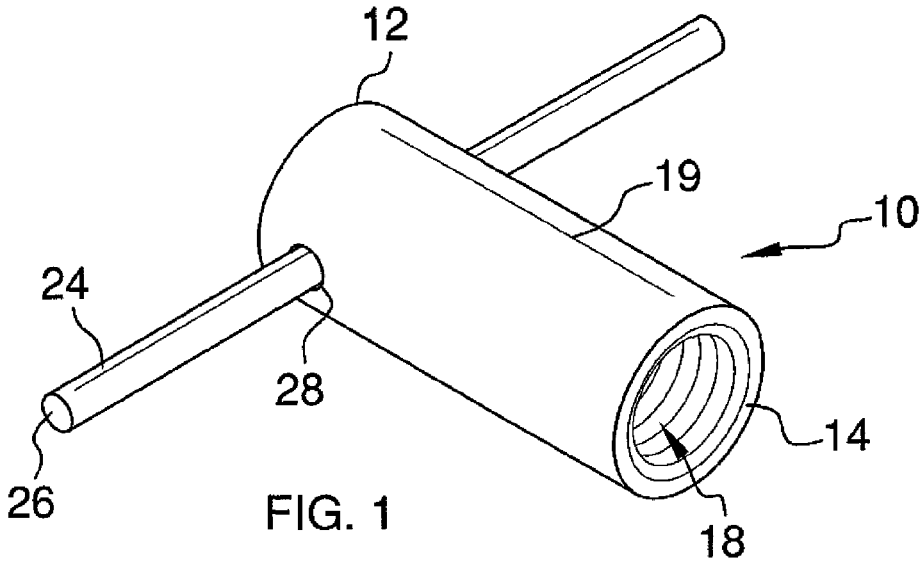
FIG. 1 is a perspective view of a watercraft anode removal tool and method according to the present invention.
Figure 2:
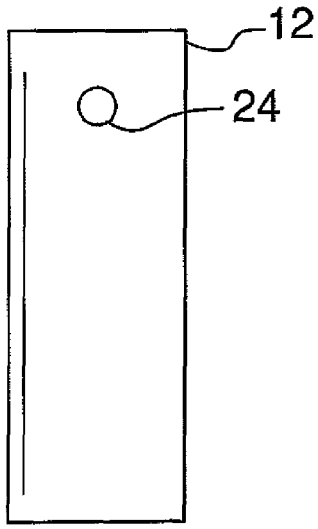
FIG. 2 is a right view of the present invention.
Figure 3:
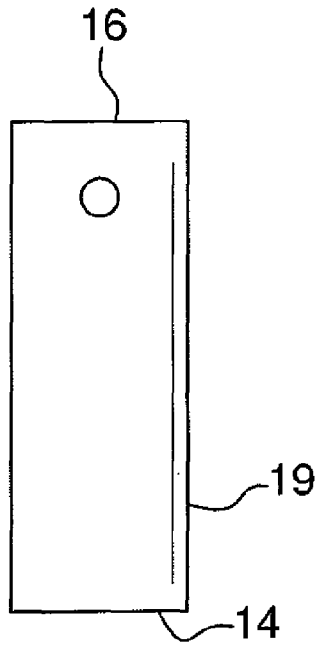
FIG. 3 is a left side view of the present invention.
Figure 4:
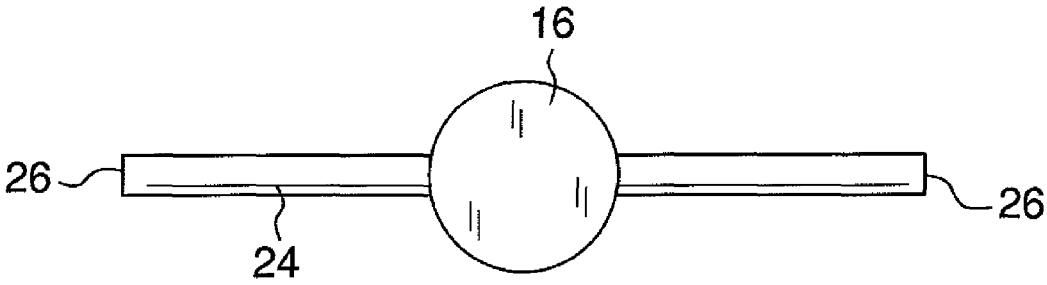
FIG. 4 is a top view of the present invention.
Figure 5:
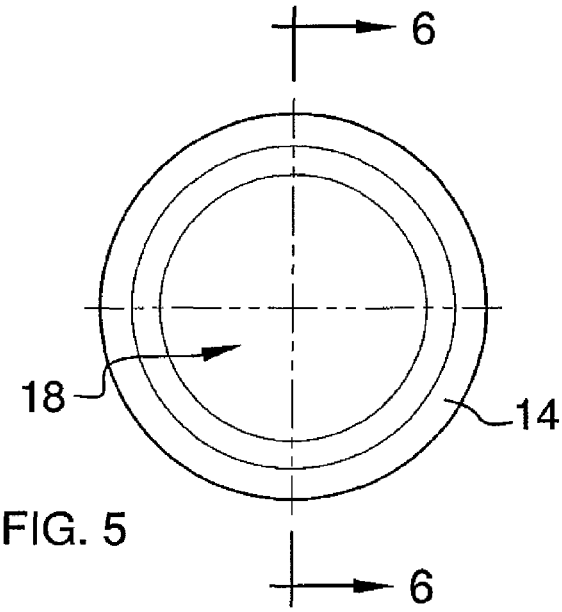
FIG. 5 is a bottom view of the present invention.
Figure 6:
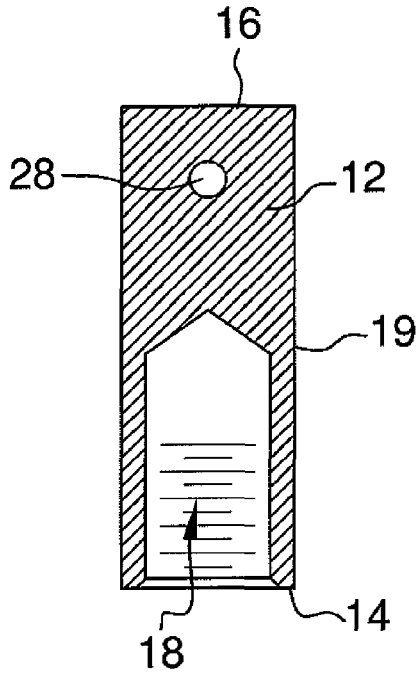
FIG. 6 is a cross-sectional view taken along line 6-6 of FIG. 5 of the present invention.
Figure 7:
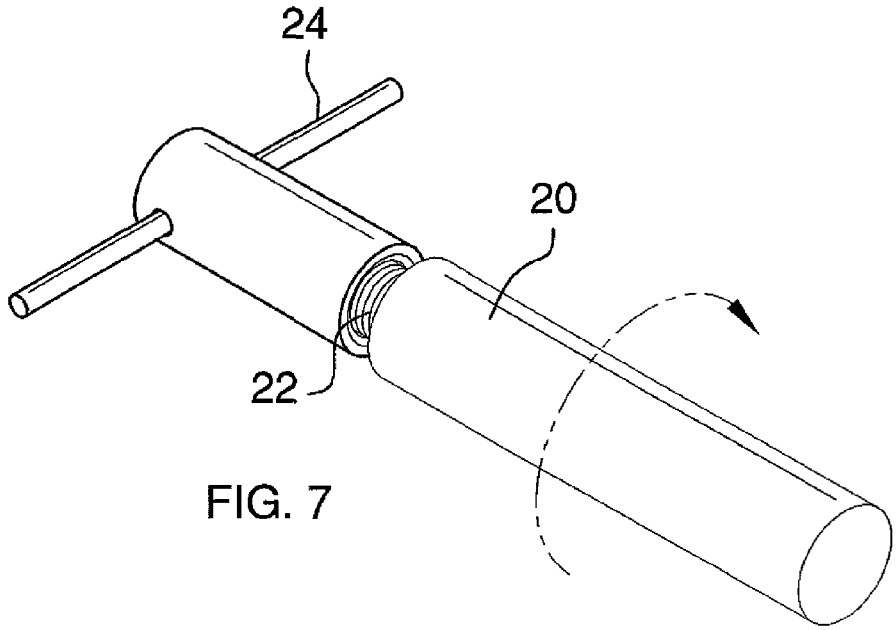
FIG. 7 is a perspective in-use view of an embodiment of the present invention.

With reference now to the drawings, and in particular to FIGS. 1 through 7 thereof, a new anode removal tool embodying the principles and concepts of the present invention and generally designated by the reference numeral 10 will be described.

As best illustrated in FIGS. 1 through 7, the watercraft anode removal tool 10 and method generally comprises a cylinder 12 has a first end 14, a second end 16 and peripheral wall 19 extending between the first 14 and second 16 ends. The first end 14 has a well 18 therein for receiving an end of a zinc pencil 20. Zinc pencils 20, as they are commonly known, are used as anodes in engines, particularly in marine engines, to prevent the corrosion of the engine components. As zinc oxidizes more efficiently than the metals comprising the engine, the zinc will rust instead of the components and the zinc pencil 20 can then be replaced as need. However, when removing the zinc pencil 20, the zinc holder attached to the zinc pencil often becomes dislodged from the zinc pencil 20 leaving the zinc pencil 20 in the engine with no way to remove it but to disassemble whatever component contains the zinc pencil 20.

The well 18 of the cylinder 12 is threaded and is threadably couplable to a threaded end 22 of the zinc pencil 20 which is exposed when the zinc pencil 20 holder is removed. The cylinder 12 has length from the first end 14 to the second end 16 between 1.25 inches and 1.75 inches and a diameter between 0.3 inches and 0.75 inches. The well 18 has a diameter between 0.25 inches and 0.57 inches and a depth from the first end 14 at least equal to 0.50 inches to ensure enough of the zinc pencil 20 is retained by the well 18.

A rod 24 is elongated and has a pair of opposing ends 26. The rod 24 is removably extended into an aperture 28 extending through the cylinder 12. The aperture 28 is positioned between the well 18 and the second end 16 of the cylinder 12. The aperture 28 is oriented perpendicular to and bisects a longitudinal axis of the cylinder 12 extending through the first 14 and second 16 ends.

In use, when the zinc pencil 20 is being removed and its holder accidentally releases from the zinc pencil 20, the cylinder 12 is threadably coupled to the zinc pencil 20 and the cylinder 12 pulled to remove the zinc pencil 20. The rod 24 is gripped during this process to give the user of the tool 10 more leverage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of engaging and urging an anode from a watercraft engine comprising the steps of:

providing a zinc pencil defining an anode inserted into the watercraft engine;

providing a tool for engaging said zinc pencil, said tool including a cylinder having a first end, a second end and peripheral wall extending between said first and second ends, said first end having a well therein for receiving an end of the zinc pencil, said well being threaded, said cylinder having an outer surface being free of threading;

threadably coupling said cylinder to said zinc pencil after a zinc holder attached to said zinc pencil becomes dislodged from said zinc pencil; and pulling the zinc pencil from the engine.

2. The method according to claim 1, wherein the step of providing the tool further includes the step of said cylinder having length from said first end to said second end between 1.25 inches and 1.75 inches and a diameter between 0.3 inches and 0.75 inches.

3. The method according to claim 2, wherein the step of providing the tool further includes the step of said well having a diameter between 0.25 inches and 0.57 inches, said well having a depth from said first end at least equal to 0.50 inches.

4. The method according to claim 3, wherein the step of providing the tool further includes the step of providing a rod being elongated and having a pair of opposing ends, said rod being removably extended into an aperture extending through said cylinder, said aperture being positioned between said well and said second end of said cylinder, said step of pulling said zinc pencil including the step of gripping said rod.

5. The method according to claim 4, wherein the step of providing the tool further includes the step of said aperture being oriented perpendicular to and bisecting a longitudinal axis of said cylinder extending through said first and second ends.

6. The method according to claim 1, wherein the step of providing the tool further includes the step of providing a rod being elongated and having a pair of opposing ends, said rod being removably extended into an aperture extending through said cylinder, said aperture being positioned between said well and said second end of said cylinder, said step of pulling said zinc pencil including the step of gripping said rod.

* * * * *